US008702447B2

(12) United States Patent
Lau

(10) Patent No.: US 8,702,447 B2
(45) Date of Patent: Apr. 22, 2014

(54) DETACHABLE ELECTRICAL EXTENSION SOCKETS

(76) Inventor: Teik Hock Lau, Johor Bahru (MY)

( * ) Notice: Subject to any disclaimer, the term of this patent is extended or adjusted under 35 U.S.C. 154(b) by 148 days.

(21) Appl. No.: 13/266,417

(22) PCT Filed: Jul. 28, 2009

(86) PCT No.: PCT/MY2009/000104

§ 371 (c)(1),
(2), (4) Date: Oct. 26, 2011

(87) PCT Pub. No.: WO2010/056102

PCT Pub. Date: May 20, 2010

(65) Prior Publication Data

US 2012/0052742 A1 Mar. 1, 2012

(30) Foreign Application Priority Data

Nov. 12, 2008 (MY) ..... PI20084540

(51) Int. Cl.
*H01R 13/60* (2006.01)

(52) U.S. Cl.
USPC ..... 439/535; 439/214; 439/620.21

(58) Field of Classification Search
USPC ..... 439/535, 214, 640, 652
See application file for complete search history.

(56) References Cited

U.S. PATENT DOCUMENTS

| | | | | | |
|---|---|---|---|---|---|
| 5,292,257 | A | * | 3/1994 | Milan | 439/214 |
| 5,582,522 | A | * | 12/1996 | Johnson | 439/214 |
| D381,315 | S | * | 7/1997 | Harold | D13/139.4 |
| 5,658,158 | A | * | 8/1997 | Milan | 439/214 |
| 5,788,521 | A | * | 8/1998 | Milan | 439/214 |
| 6,454,584 | B1 | * | 9/2002 | Milan | 439/214 |
| 7,264,514 | B2 | * | 9/2007 | Hsu et al. | 439/640 |
| D556,689 | S | * | 12/2007 | Lee et al. | D13/139.1 |
| 7,488,204 | B2 | * | 2/2009 | Hsu | 439/535 |
| D597,948 | S | * | 8/2009 | Bizzell | D13/139.1 |
| 7,607,928 | B2 | * | 10/2009 | Schriefer et al. | 439/214 |
| 7,824,185 | B2 | * | 11/2010 | Chien | 439/11 |
| 7,874,856 | B1 | * | 1/2011 | Schriefer et al. | 439/214 |
| D633,045 | S | * | 2/2011 | Cullen et al. | D13/139.8 |
| 8,011,930 | B2 | * | 9/2011 | Lee et al. | 439/18 |
| 8,038,454 | B2 | * | 10/2011 | Jiang et al. | 439/106 |

(Continued)

FOREIGN PATENT DOCUMENTS

| | | | |
|---|---|---|---|
| JP | 2005/327632 | A | 11/2005 |
| KR | 2008/0030867 | A | 4/2008 |
| KR | 20080040530 | A | 5/2008 |

OTHER PUBLICATIONS

International Serch Report, Apr. 21, 2010, from International Phase of the instant application.

*Primary Examiner* — Amy Cohen Johnson
*Assistant Examiner* — Vladimir Imas
(74) *Attorney, Agent, or Firm* — Jackson Patent Law Office

(57) ABSTRACT

The present invention relates generally to an electrical extension sockets, and more particularly to a detachable electrical extension sockets having plurality of individual electrical extension sockets which are detachable with one another. Each of the electrical extension sockets is having male and female connectors. The male and female connectors are arranged in such a way to compliment each other to form extension. In addition, each electrical extension socket is provided with a printed circuit board (PCB) to replace wires for connection for delivering electricity from a power supply to a power plug connected from an electrical appliance.

13 Claims, 8 Drawing Sheets

(56) References Cited

U.S. PATENT DOCUMENTS

| | | | | |
|---|---|---|---|---|
| 8,052,437 | B2 * | 11/2011 | Jiang et al. | 439/106 |
| 8,118,616 | B1 * | 2/2012 | Clark | 439/640 |
| 8,157,574 | B2 * | 4/2012 | Hsiao | 439/131 |
| D667,795 | S * | 9/2012 | Zien et al. | D13/139.4 |
| 8,262,399 | B1 * | 9/2012 | Zien et al. | 439/188 |
| 8,283,802 | B2 * | 10/2012 | Jansma et al. | 307/23 |
| D677,630 | S * | 3/2013 | Zien et al. | D13/139.8 |
| 2006/0234561 | A1 * | 10/2006 | Tanaka | 439/652 |

* cited by examiner

DETACHABLE ELECTRICAL EXTENSION SOCKETS

1. TECHNICAL FIELD OF THE INVENTION

The present invention relates generally to an electrical extension sockets, and more particularly to an electrical extension sockets having a plurality of individual electrical outlets with each electrical outlet having detachably means for connecting with each other.

2. BACKGROUND OF THE INVENTION

Generally, a power outlet installed on the wall of a house is used to plug in household electric appliances, electronic devices or personal computers. Since most standard wall-type power outlets provide one or two receptacles in one place, only one or two electronic devices can be plugged in at any one time.

Often, the number of appliances or electronic devices one needs to plug in exceeds the number of receptacles on the wall-type electric outlet or the wall outlet is located far from the electronic devices. In this situation, if one needs to plug in more than two electronic devices such as a personal computer with its peripheral equipment, an extra electrical outlet with multiple receptacles is required. Also, with the rapid increase in the number of electrical and electronic products in a typical home, power strips employing multiple power outlets have become common, resulting in an increase in the number of electrical power outlets in the typical modern home. Computers, stereo equipment, DVD players, television sets and the like are supplied with plugs, pins, receptacles and sockets that must work together for effective operation of the equipment.

Extension sockets are often used to transmit power to locations that are removed from the conventional wall-mounted electrical outlets. They provide continuous connection between power sources and devices that require electricity to function properly, such as lights, tools and industrial equipment. Generally, an extension socket consists of an openings or female adapter, into which a plug that is attached to a device can be inserted, and an encased wire that travels from the female adapter to the power supply. The number of shape of the openings in female adapters are designed to receive prongs from a corresponding male adapter.

Providing power for each of the electrical outlets requires wiring the outlets to a source of electricity. Electrical receptacles or electrical sockets are usually provided in the form of a duplex receptacle having two receptacle outlets. Two duplex receptacles can be placed side by side to form a quadplex receptacle, however, each of the duplex receptacles must be separately wired. Accordingly, the more receptacle outlets needed or provided in a structure, the more wiring required. This can lead to mistakes in wiring and increases the time and cost of installation.

Presently, the conventional electrical outlets have long rectangular shape of simple design with simple function including a main switch. Such a simple design of electrical outlets may not be attractive to the user or potential buyer. If one sees a dusty electric outlet in a corner of the room, one would find it objectionable.

Now, the concepts have changed and many people want to observe pleasantness even in such a trivial object. If one sees a well-decorated, colorful and attractive electrical outlet on the wall or in the corner of the room instead of a dusty and boring shaped electrical outlet, one may feel content.

The present invention proposes a more attractive electrical extension sockets having individual sockets and are detachable with one another. Also, the present invention provides electrical extension sockets that are easy to carry and need small space for keeping when not in use. Detachable concept by the present invention offers user with neatness and selections.

3. SUMMARY OF THE INVENTION

Accordingly, it is an object of the present invention to provide an electrical extension sockets having plurality of individual sockets for the convenience of the user.

Yet, it is another object of the present invention to provide an electrical extension sockets where each electrical extension socket is detachable from one another.

These and other objects of the present invention are achieved by,

A detachable electrical extension sockets comprises of:

- a main socket (1) for connection to a source of power supply;
- at least one additional electrical extension socket (2) electrically connected to said main socket (1), characterized in that;

- said additional electrical extension socket (2) is detachably connected to said main socket (1) through male and female connectors meant for complimenting each other to form extension to said main socket (1).

Preferably, said male and female connectors are having features and shapes so as to compliment each other.

More preferably, each electrical extension socket is having multiple female slots.

More preferably, printed circuit board (PCB) is used to replace wires within each electrical extension socket.

More preferably, the printed circuit board (PCB) and plurality of metal components are secured with each other to deliver electricity.

The object of the present invention may also be accomplished by,

A detachable electrical extension sockets comprises of:

- a main socket (1) for connection to a source of power supply;
- at least one additional electrical extension socket (2) electrically connected to said main socket (1), characterized in that;

- an end electrical extension socket (3) is arranged at the end section of said detachable electrical extension socket.

4. BRIEF DESCRIPTION OF THE DRAWINGS

Other aspect of the present invention and their advantages will be discerned after studying the Detailed Description in conjunction with the accompanying drawings in which.

Figure 4A:
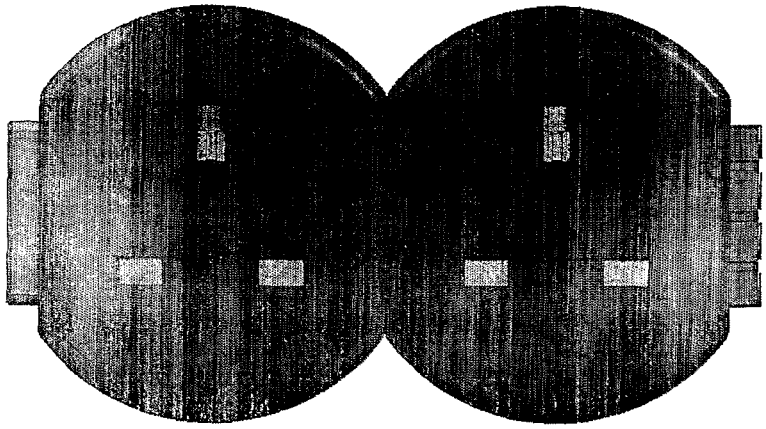
Figure 4B:
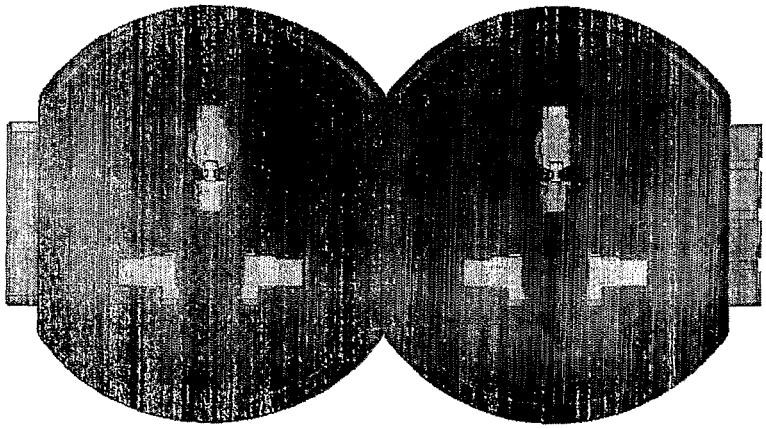

FIGS. 4*a* and 4*b* show variety of sockets arrangement according to the present invention.

Figure 5:
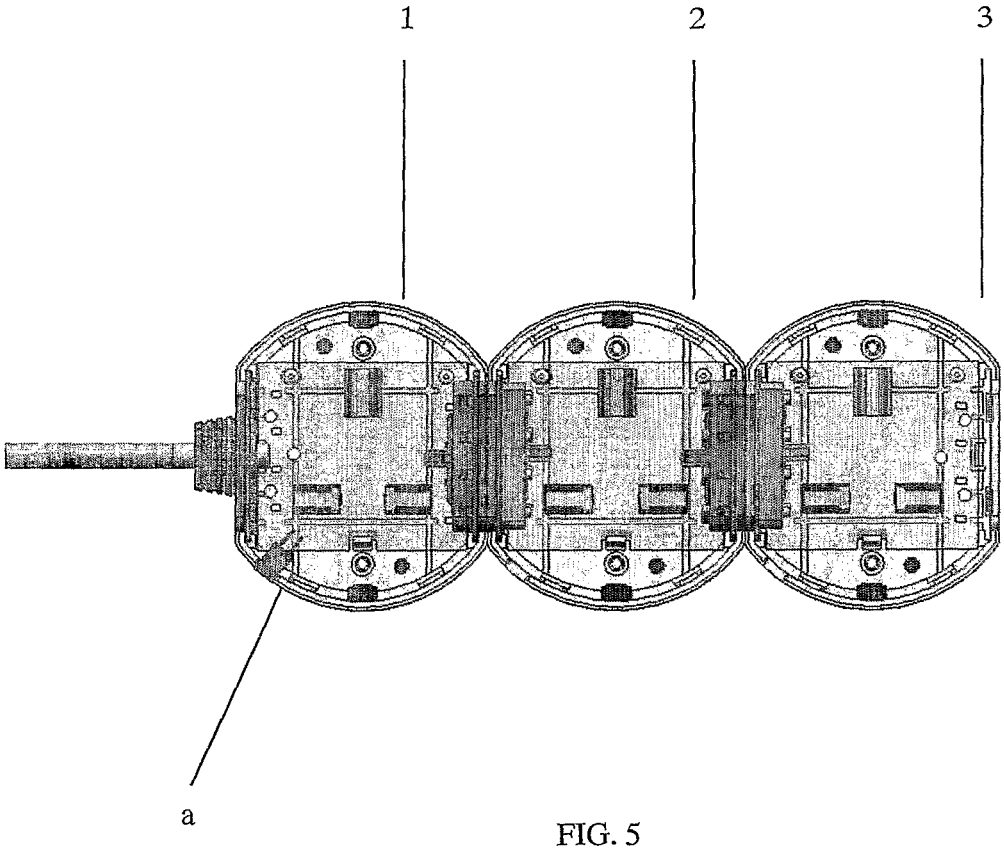

FIG. 5 shows internal configuration of the electrical socket according to the present invention.

Figure 6:
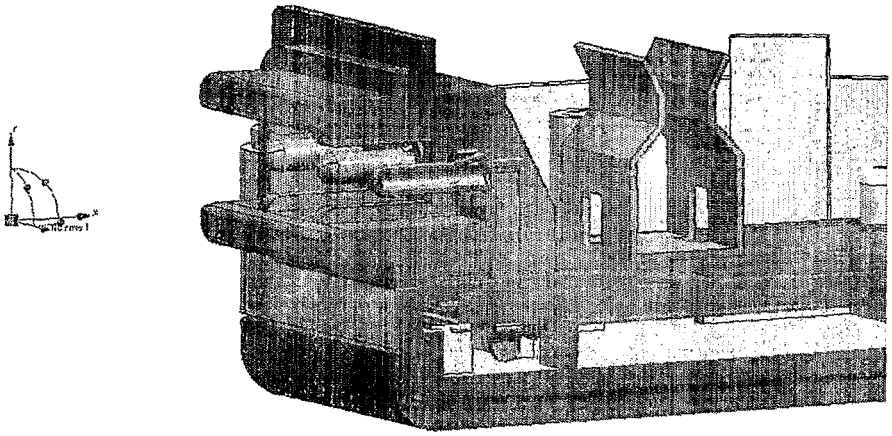

FIG. 6 shows structure of male connectors of a detachable extension sockets according to the present invention.

Figure 7:
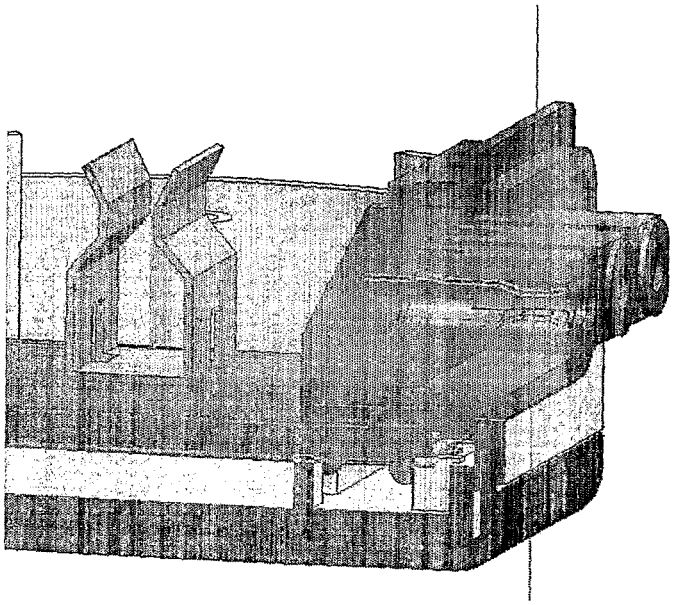

FIG. 7 shows structure of female connectors of a detachable extension sockets according to the present invention.

Figure 8:
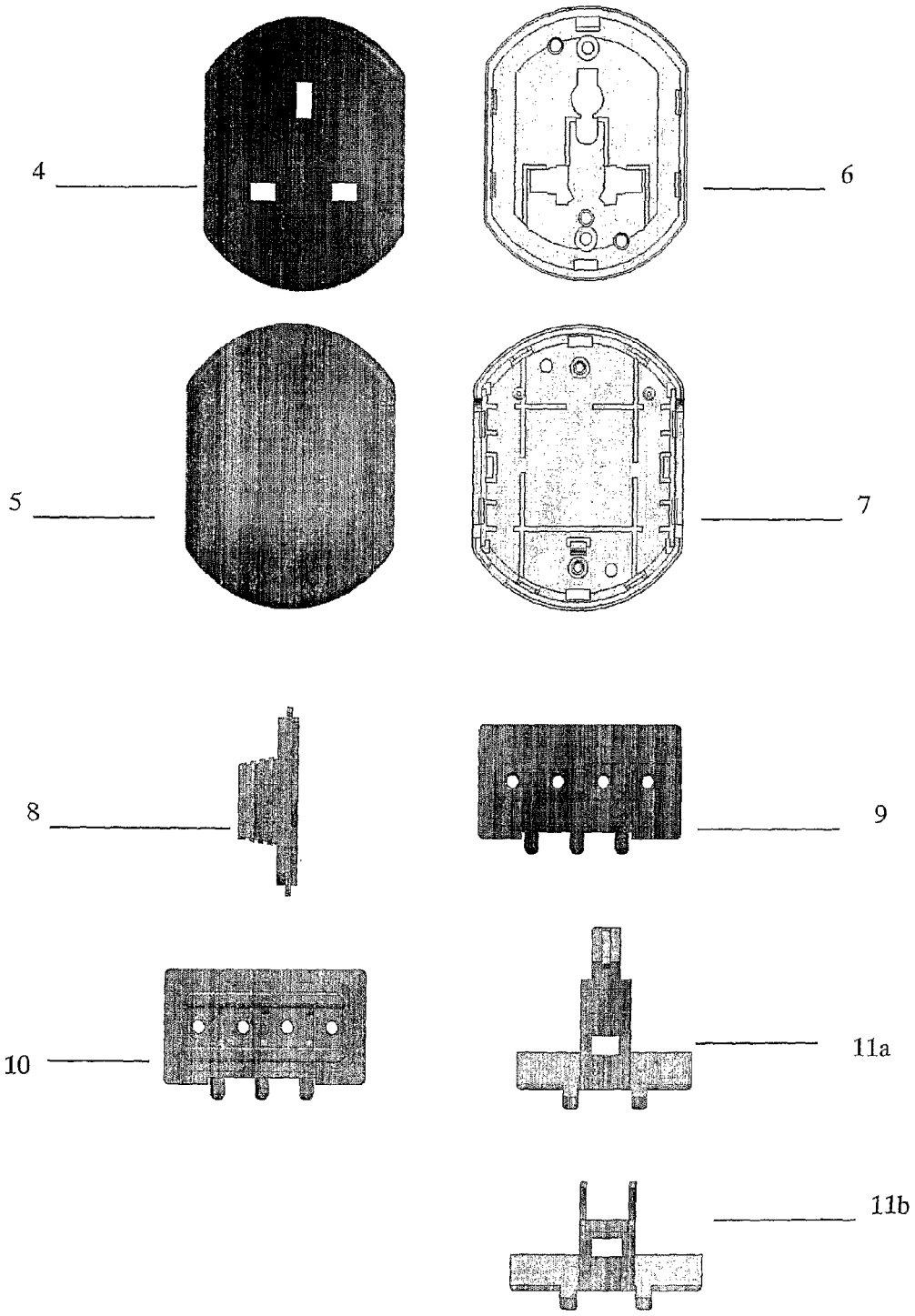

FIG. 8 shows plastic components of a detachable electrical extension sockets according to the present invention.

Figure 9:
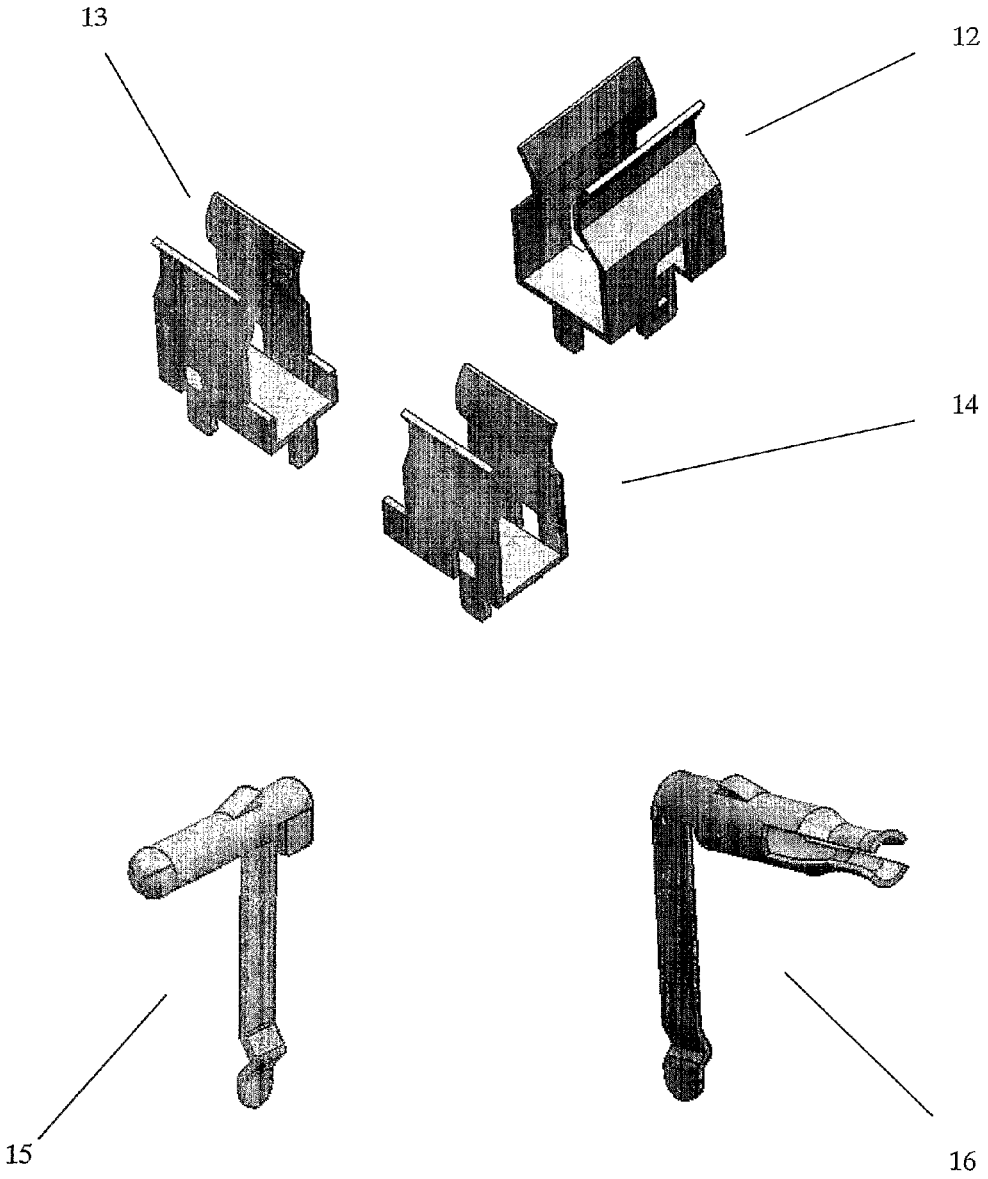

FIG. 9 shows metal components of a detachable electrical extension sockets according to the present invention.

Figure 10:
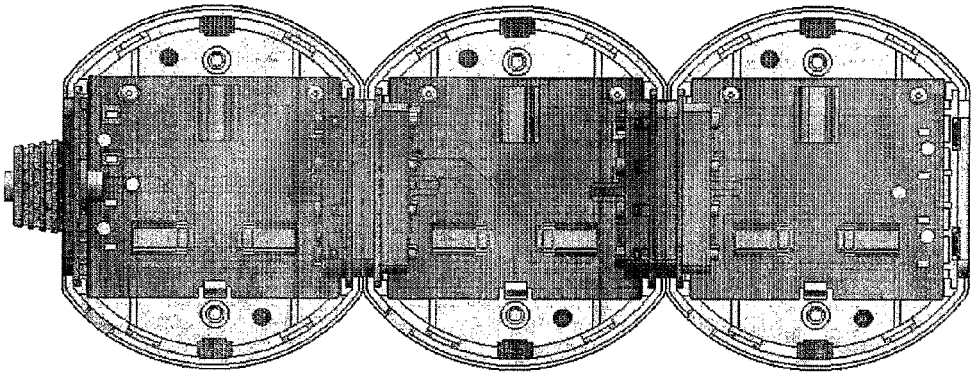

FIG. 10 shows top view of a detachable electrical extension sockets configured with a printed circuit board (PCB) according to the present invention.

Figure 11:
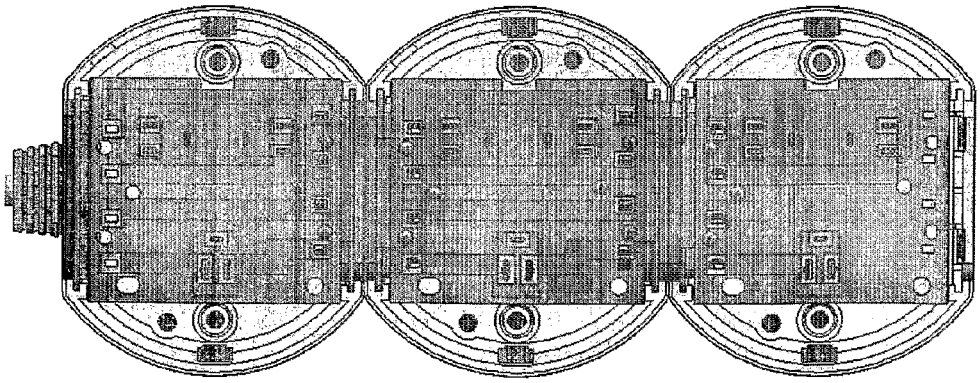

FIG. 11 shows bottom view of a detachable electrical extension sockets of FIG. 10.

5. DETAIL DESCRIPTION OF THE DRAWINGS

Figure 1:
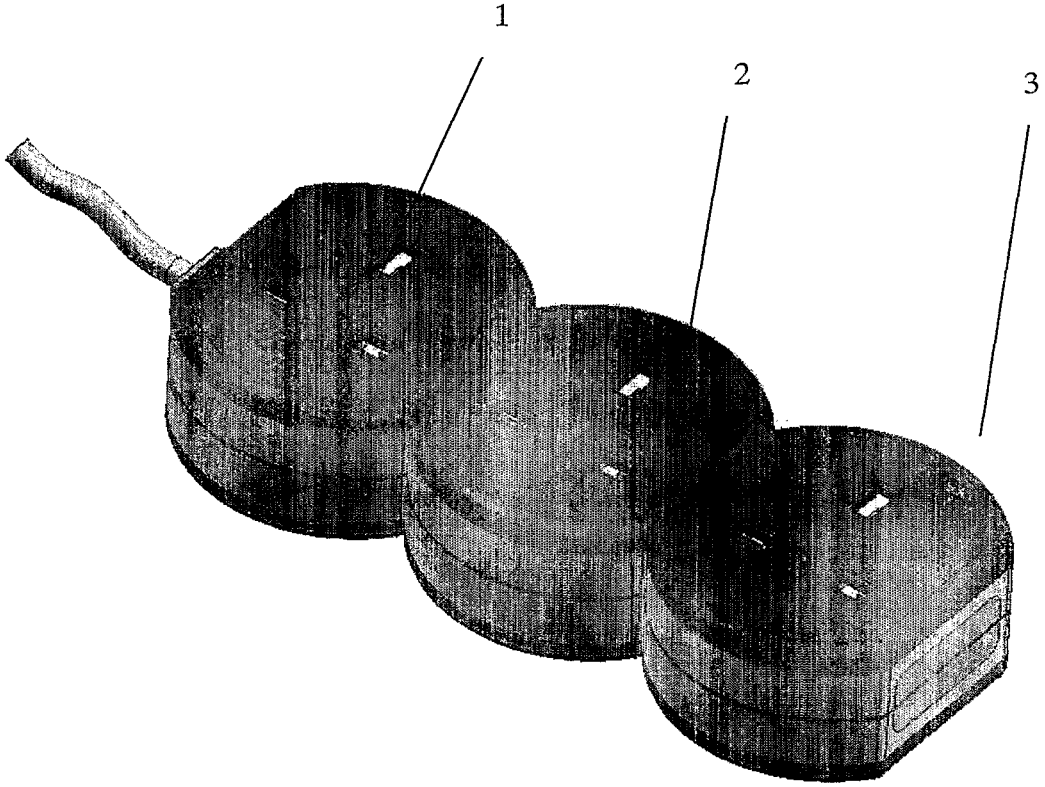
FIG. 1 shows perspective view of a detachable electrical extension sockets according to the present invention.
Figure 2:
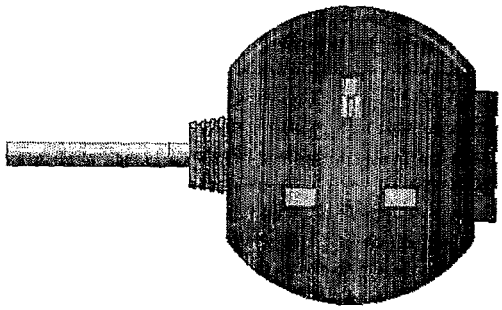
FIG. 2 shows the main socket of a detachable electrical extension sockets according to the present invention.
Figure 3:
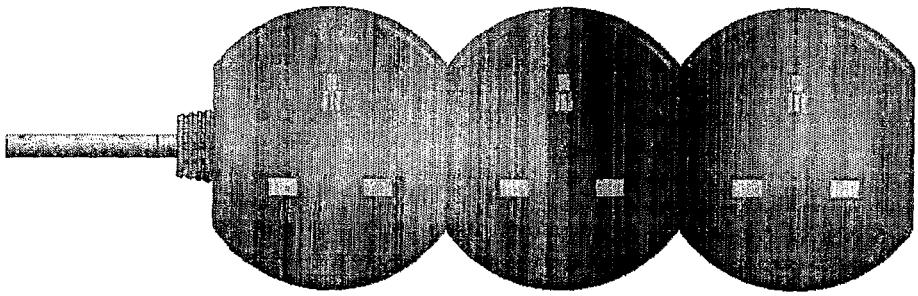
FIG. 3 shows a connection of a detachable electrical extension sockets according the present invention.

FIG. 1 shows perspective view of an example of a complete assembly of the present invention. In this figure, three electrical extension sockets or electrical outlets are connected together. Referring to FIG. 2 and FIG. 3, in one embodiment of the present invention, the main socket (1) of the electrical extension sockets must be in connection with at least the end socket (3) of the electrical extension socket in order to work. FIG. 2 shows the main socket (1) having at one side a cable connection to a power source (not shown) and the other side is a male connector. The male connector itself having male connector pins (15) (refer to FIG. 9) for conducting electricity are exposed and this exposure may be dangerous in term of electrical shock. Therefore, referring to FIG. 3, the end socket (3) is adapted in the detachable electrical extension sockets to ensure that there is no such exposure exists and that the present invention is safe to use. In the figure, the end socket (3) is having a connector means at one side only. In other words, the detachable electrical extension socket proposed by the present invention may have plurality of extension sockets connected together but shall only work if the end socket (3) is connected to the assembly.

FIG. 6 and FIG. 7 show the detail structures of male and female connectors disposed on each electrical socket except for the main socket (1) and the end socket (3). For example, the main socket (1) of the electrical extension sockets is having at one side a cable connection to a power source (not shown) and the other side is the male connector. This male connector is adapted to engage with the female connector of the second socket (2) of the electrical extension sockets. The other side of the second socket (2) is a male connector which to engage with the female connector of the next socket, and in this example is the end socket (3). The male connector is made of a set of four male connector pins (15) having cylindrical shape and the female connector is having female connector slots (16) having shape which to adapt the male connector pin (15) with securely slotted feature. As mentioned in the above paragraph, if connection is made between the main socket (1) of the electrical extension sockets and the second socket (2) of the electrical extension sockets only, the present invention shall not work due to safety reason, and the reason is that the male connector from the second socket (2) is exposed. Therefore, one may accidently get electrical shock due to improper handling and thus the invention requires at least the main socket (1) and the end socket (3) of the electrical extension sockets being connected to make it work. In between the main socket (1) and the end socket (3) of the electrical extension sockets, one can have several electrical sockets as one needs. In addition, the connection of every electrical socket is in such a way that there is no gap exists in between. This is important so that the male and female pins are not exposed as to avoid danger of getting electrical shock.

FIG. 4 shows two alternative designs of electrical sockets configured according to the present invention. Electrical sockets are usually designed to accept plug which is built to the same electrical standard. As shown in the figure, for example, FIG. 4*a* is designed for Malaysia standard and BS standard electrical sockets and in FIG. 4*b* is designed for CE and universal type standards electrical sockets for receiving various types of pins plugs. It should be noted here that these are only examples and many other types of female electrical connectors may also be adapted. As each electrical socket is detachable with each other, one may use different types of electrical appliances having different type of pins plugs. However it may be made dependent on the power rating of each appliance.

FIG. 5 shows the internal configuration of the electrical socket according to the present invention. The three electrical sockets in connection with the main socket (1) on the left side, followed by the second socket (2) and ended with the end socket (3). As illustrated, the present invention introduces a printed circuit board (PCB) to replace the use of wires for connection between pins as found in conventional electrical extension socket. The detail structure of the PCB is illustrated in FIG. 10 and FIG. 11. The present invention proposes a double-sided PCB to replace wires as found in conventional electrical extension. FIG. 10 shows the upper view and FIG. 11 shows the bottom view. Also, at the main socket (1) of the electrical extension sockets, there is a LED (a) which will illuminate to indicate that the connection is working and power is being supplied. The LED (a) may come in different colours such as red, blue, green etc. Also, at the main socket (1) of the electrical extension socket, an AC cord is securely held by an AC cord holder (8).

FIG. 8 and FIG. 9 show plastic components and metal conductors respectively as proposed by the present invention. Each of the electrical extension sockets is constructed with an upper body (6) and lower body (7) with all the plastic components and metal conductors disposed within the upper body (6) and the lower body (7). The top cover (4) and bottom cover (5) are secured onto the upper body (6) and lower body (7) respectively. The AC cord holder (8) is secured at one side of the main socket (1) of the electrical extension sockets which connected to the power supply AC cord whereas at the male connector side, a male connector housing (9) is secured. For every electrical socket, there are connector housings, one for male connector housing (9) and the other is for female connector housing (10) and also shutter mechanism, they are 3 pin shutter (11*a*) and 2 pin shutter (11*b*). These shutters are disposed underneath the top cover (4) to block the openings at the top cover (4) so as to prevent entry of foreign objects. The 3 pin shutter (11*a*) is to be incorporated in the electrical extension sockets catered to BS standard whereas the 2 pin shutter (11*b*) is to be incorporated in the electrical extension sockets catered to Universal standard. Also at the male connector and female connector, there are associated male connector pin (15) and female connector pin (16) and they are made of metal. At the three conductor pins, earthed pin (12), neutral pin (13) and live pin (14) are metal conductors where power shall be delivered to the connected plug.

While a particular form of the present invention has been illustrated and described, it will be apparent that many varying embodiments with various modifications can be made without departing from the scope of the invention. Therefore, it is understood that the detail herein are to be interpreted as illustrative and not in a limiting sense.

What is claimed is:

1. An electrical extension socket assembly comprising:

a first housing defining a first side, a second side, and a third side;

a cable extending out of the first side of the first housing, the cable being configured for connection to a power source;

a socket, on the second side of the first housing, the socket being configured to connect to a plug of an appliance, and selectively deliver power to a connected plug;

an electrical connector on the third side of the first housing, the electrical connector having a first gender;

a second housing defining a first side, and a second side;

an electrical connector, on the first side of the second housing, the electrical connector having a second gender, the second gender being opposite the first gender, the electrical connector of the second housing being detachably connectable to the electrical connector of the first housing; and a socket, on the second side of the second housing, the socket being configured to connect to a plug of an appliance, wherein the socket, of the first housing, functions to deliver power to a connected plug only when the connector of second housing is electrically coupled to the connector of the first housing.

2. An electrical extension socket assembly as claimed in claim 1, further characterized in that a plurality of additional sockets are coupled to the first housing.

3. An electrical extension socket assembly as claimed in claim 1, further characterized in that the electrical connector on the first housing is so as to compliment the electrical connector on the second housing.

4. An electrical extension socket assembly as claimed in claim 1, further characterized in that the connection of the electrical connectors is hidden from view.

5. An electrical extension socket assembly as claimed in claim 1, further comprising a plurality of plastic components and a plurality of metal components arranged to allow delivery of power to each socket.

6. An electrical extension socket assembly as claimed in claim 1, further characterized in that coupling between the first and second housing is made through use of a printed circuit board (PCB).

7. An electrical extension socket assembly as claimed in claim 6, further characterized in that the PCB and a plurality of metal components are arranged in such a way that electricity may be delivered from a power supply to a power plug of an electrical appliance connected to the socket of the first housing.

8. An electrical extension socket assembly as claimed in claim 1, further characterized in that each socket is a female slot type.

9. An electrical extension socket assembly as claimed in claim 8, further characterized in that the second housing is to provide safety.

10. An electrical extension socket assembly as claimed in claim 8, further comprising a plurality of subassemblies each subassembly comprising a third housing defining a first side, a second side, and a third side;

an electrical connector, on the first side of the third housing, the electrical connector having the second gender, the electrical connector of the third housing being detachably connectable to the electrical connector of the first housing;

a socket, on the second side of the third housing, the socket being configured to connect to a plug of an appliance;

an electrical connector, on the third side of the third housing, the electrical connector having the first gender, characterized in that the plurality of subassemblies are positioned between the first and second housings.

11. An electrical extension socket assembly according to claim 1, further comprising: a third housing defining a first side, a second side, and a third side;

an electrical connector, on the first side of the third housing, the electrical connector having the second gender, the electrical connector of the third housing being detachably connectable to the electrical connector of the first housing;

a socket, on the second side of the third housing, the socket being configured to connect to a plug of an appliance;

an electrical connector, on the third side of the third housing, the electrical connector having the first gender, wherein the electrical connector of the second housing is detachably connectable to the electrical connector of the third housing, whereby the electrical connector of the first housing is electrically coupled to the electrical connector of the second housing.

12. An electrical extension socket assembly according to claim 1 wherein the first gender is male and the second gender is female.

13. An electrical extension socket assembly according to claim 1 wherein the second housing does not have an electrical connector having the first gender.

* * * * *